US010750848B2

(12) United States Patent
Ponzini

(10) Patent No.: US 10,750,848 B2
(45) Date of Patent: Aug. 25, 2020

(54) ORAL HYGIENE OR COSMETIC APPLICATOR BRUSH DEVICE AND MANUFACTURING METHOD THEREOF

(71) Applicant: PONZINI S.p.A., Lazzate MB (IT)

(72) Inventor: Eligio Ponzini, Lazzate MB (IT)

(73) Assignee: PONZINI S.P.A., Lazzate (IT)

( * ) Notice: Subject to any disclaimer, the term of this patent is extended or adjusted under 35 U.S.C. 154(b) by 208 days.

(21) Appl. No.: 15/766,691

(22) PCT Filed: Oct. 7, 2016

(86) PCT No.: PCT/IB2016/056019

§ 371 (c)(1),
(2) Date: Apr. 6, 2018

(87) PCT Pub. No.: WO2017/060868

PCT Pub. Date: Apr. 13, 2017

(65) Prior Publication Data

US 2018/0295977 A1 Oct. 18, 2018

(30) Foreign Application Priority Data

Oct. 8, 2015 (IT) ..... UB2015A4213

(51) Int. Cl.
*A46B 3/18* (2006.01)
*A46B 9/02* (2006.01)
(Continued)

(52) U.S. Cl.
CPC ..... *A46B 3/18* (2013.01); *A46B 9/021* (2013.01); *A46D 3/005* (2013.01); *A46B 5/002* (2013.01);
(Continued)

(58) Field of Classification Search
CPC ..... A46B 3/18; A46B 9/021; A46B 5/002; A46B 2200/1053; A46B 2200/108; A46D 3/005
See application file for complete search history.

(56) References Cited

U.S. PATENT DOCUMENTS 3,837,751 A 9/1974 Ross
8,607,398 B2 12/2013 Zahoransky et al.
(Continued)

FOREIGN PATENT DOCUMENTS

EP 1 862 090 12/2007
EP 1 917 883 5/2008
WO WO 2013/034638 3/2013

OTHER PUBLICATIONS

International Search Report, PCT/IB2016/056019, dated Feb. 2, 2017.

*Primary Examiner* — Weilun Lo
(74) *Attorney, Agent, or Firm* — Young & Thompson

(57) ABSTRACT

Disclosed is a brush-like device and related manufacturing method. The device includes at least a handle head portion obtained by way of plastic material moulding on a terminal portion of a metal stem on which bristles of the brush are fixed, the terminal portion of the stem being retained in the moulding position by a through seat of a mould which closes on the stem, and wherein, prior to the moulding of the head portion, it is provided to apply a covering sheath of elastically yieldable material on the terminal portion of the stem, the sheath being of elongate tubular shape having a length of at least 2.5 mm.

17 Claims, 7 Drawing Sheets

(51) Int. Cl.
*A46D 3/00* (2006.01)
*A46B 5/00* (2006.01)

(52) U.S. Cl.
CPC . *A46B 2200/108* (2013.01); *A46B 2200/1053* (2013.01)

(56) References Cited

U.S. PATENT DOCUMENTS

| | | | | |
|---|---|---|---|---|
| 2010/0192320 | A1* | 8/2010 | Borsari | A46B 3/18 15/206 |
| 2012/0060308 | A1 | 3/2012 | Zahoransky | |
| 2012/0198639 | A1* | 8/2012 | Smith | A46B 3/18 15/104.05 |
| 2012/0305022 | A1* | 12/2012 | Bickford | A46B 15/0016 132/218 |
| 2012/0315076 | A1* | 12/2012 | Bekele | A61K 8/375 401/129 |
| 2015/0230588 | A1* | 8/2015 | Pires | A45D 40/262 401/129 |

* cited by examiner

ORAL HYGIENE OR COSMETIC APPLICATOR BRUSH DEVICE AND MANUFACTURING METHOD THEREOF

FIELD OF THE INVENTION

The present invention relates to a brush-like device for the interdental cleaning or cosmetic application or similar tool and a related manufacturing method thereof.

BACKGROUND STATE OF THE ART

In the oral hygiene field the so-called interdental cleaning brushes are widespread, which are generally constituted by a suitably shaped supporting shank, referred to as "handle", having a free end on which a small elongated brush body is mounted, briefly referred to as "brush".

Essentially, two kinds of brush-like devices are commercially available and, namely, a "standard" type, whose handle has practically the sizes of a toothbrush and has an interchangeable brush, and a "pocket" type, whose handle is considerably smaller and conceived as single disposable element.

The active part, i.e., the brush itself, comprises a thin stem portion from which a plurality of bristles radially branches for cleaning action. The stem is typically in the form of a twisted pair of metal wires, possibly coated with plastic material, among which turns, the bristles remain locked. An appendix part of the stem is free from bristles and constitutes the so-called "tang", which is used for the engagement with the handle. The bristles project towards a reference surface which may take many forms, but typically defines an elongated rotational body.

For obvious hygienic and functional reasons, it is appropriate that the brush is frequently replaced. To this end, at least in standard devices, it is normally provided an engagement head arranged so as to allow an easy but safe assembly and disassembly of the brush (in order to avoid that the brush accidental detaches and injures the user or is ingested in the mouth). In particular, the provisional fastening of the brush is also achieved by exploiting the large deformability of the tang.

Conversely, in the pocket devices, for sake of constructional economy and low economic impact of the handle, the brush is embedded in the handle head and it is not replaceable. This implies that the fastening system of the brush must be simpler and more economical from the manufacturing point of view.

Traditionally, as can be imagined, the tang of the brush is hence embedded in the handle head part during the manufacturing phase, by simply inserting the tang into the mould, and moulding on it the plastic material constituting the handle.

However, this construction method entails some technical problems.

First, there is a general adaptation problem of the mould to the size of the brush stem. In fact, since the brush derives from a twisting process of two metal wires, it is not possible to ensure close tolerances; furthermore, it would be desirable to use different brushes having the same handle, but this involves providing a plurality of moulds only to accommodate the different diameters of the tangs.

Furthermore, the brush stem is retained in a through seat of the mould which, having theoretically a circular profile, cannot perfectly match the real tang section which, instead, derives from the profile of twisted metal wires. Therefore, considering the natural coupling tolerances, gaps between stem and shape of the mould are formed which allow a partial leakage of the molten plastic material, which is injected at high pressure into the mould, with an unwanted formation of moulding burrs.

To partially solve this problem, it has been proposed to shape the mould with an expansion chamber at the insertion position of the tang, in order to locally reduce the pressure and eliminate the burr problem. However, this leads to the formation of a small spherical body at the handle end, which does not meet the users' consent.

Alternatively, it is possible to size the seat of the mould so that it strongly clamps the stem of the brush: this solution, however, leads to a localized hardening or yield of the metal wires, which, then, lose resiliency. Therefore, when the brush is subjected to a lateral force, tends to remain folded on one side, which represents a defect.

This problem has already been tackled in the prior art, by providing the insertion of specific gaskets on the tang, in the position where the mould should close. For example, U.S. Pat. No. 8,607,398 discloses a construction method in which a plastic deformable ring is mounted on the tang, which has also a tapered cross-section to better lock, in the closing area of the mould.

However, this technique involves a series of problems, both to handle and mount the sealing ring on the tang, and to ensure that its position is always centered in the desired position.

But above all, there is the additional problem of being able to maintain the extension of naked tang (i.e. the portion between the bristles and the head end of the handle) as short as possible, both for aesthetic reasons and for functional reasons (to reduce the length of the stem which remains without a lateral support). With a traditional mould, this extension cannot be reduced beyond a certain extent, because the mould wall occupies a certain space. Therefore, different drawbacks are resulting, including the fact that the stem tends to remain deformed if excessively folded.

A construction technique, alternative to that of the moulding on the stem, provides the hot insertion of the stem in the plastic handle head. Also this construction method, which is not contemplated within the scope of the present application, shows other drawbacks always related to the effectiveness of the brush and the resulting aesthetics of the whole device. Moreover, also with this technique, the stem is not adequately supported and it is necessary to provide elastic support systems that complicate the construction structure, as illustrated, e.g., in EP 1862090.

All these problems are also found in the field of cosmetic applicators, e.g., mascara brushes, or for medical use, wherein the engagement of the stem bristled on the handle or retention portion, of plastic material, shows strong analogies with the sector of the interdental brushes.

In the following, we will thus refer to a brush-like device, being understood that the teaching of the invention may apply to any one of the application sectors mentioned above.

SUMMARY OF THE INVENTION

The problem underlying the present invention is to propose a brush-like device and a manufacturing method thereof, which are able to eliminate the drawbacks mentioned above; in particular, it is meant to provide a manufacturing method and a brush arrangement, which allow to avoid the formation of plastic material burrs on the brush stem, in the moulding step, but, above all which maintain an effective elasticity of the bristled part for the benefit of its operation.

These objects are achieved through a manufacturing method of a brush having the features mentioned in claim 1 and a brush-like device as in claim 6. The dependent claims describe preferred features of the invention.

BRIEF DESCRIPTION OF THE DRAWINGS

Further features and advantages of the invention are anyhow more evident from the following detailed description of some preferred embodiments, given by mere way of non-limiting example and illustrated in the accompanying drawings, wherein:

FIG. 3 is an axial sectional view of a variant of the embodiment of the invention, with a brush oriented at 90° with respect to the axis of the handle; of which

DETAILED DESCRIPTION OF THE PREFERRED EMBODIMENTS

Figure 2:
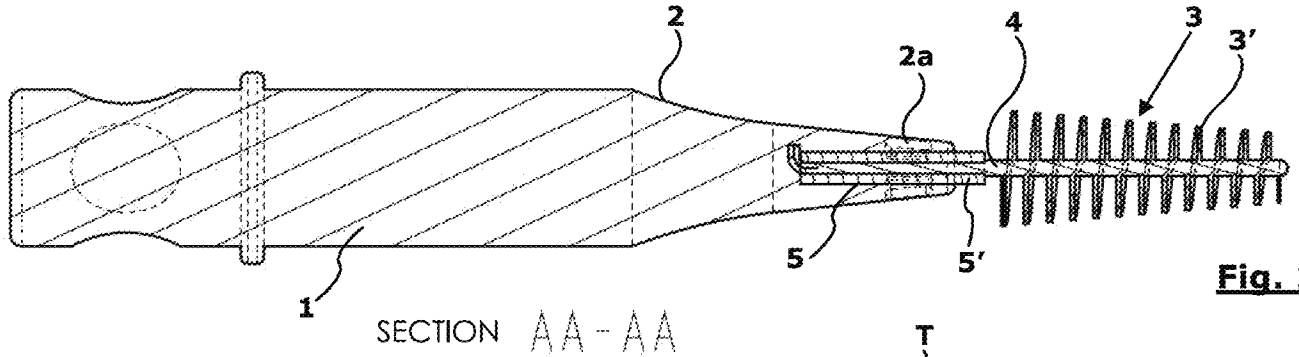
FIG. 2 is an axial sectional view, according to the line II-II of FIG. 1, of the same device of FIG. 1.

As shown in FIGS. 1-4, an interdental brush comprises, in a completely known way to a person skilled in the art, a handle 1, which ends with a support head 2 and from which support head 2 a retaining stem 4 extends. A bristled part 3 is formed by a plurality of bristles 3' mounted on the retaining stem 4. The retaining stem 4 is in turn formed by a pair of metal wires, twisted on each other, also in a well known way and which, therefore, does not require further explanations. Thus, as shown in the figures, the bristled part 3 is located on one end part of the retaining stem 4 and a terminal part free of bristles 3' is located on the other end part of the retaining stem 4 that extends into the support head 2.

The specific shape and the material used for the handle 1 do not have a significant importance in this context and, thus, will not be further described.

The only aspect to be consider is that at least the handle head 2, where the brush 3 is fixed, is constructed with mouldable plastic material.

The handle head 2 is usually formed as a cusp, in which the stem 4 or, better, the end portion free from bristles referred to, in the following, as tang, is inserted and locked. For this purpose, in the portion of the mould (represented only for its terminal part T), which determines the shape of the handle 1 head 2, a cylindrical terminal seat T' is formed, which, always according to the prior art, directly clamps around the stem 4 tang; in other words, the tang is held locked in this cylindrical seat T' of the terminal portion of the mould, during the injection moulding step of the handle head 2.

According to the present invention, on the tang or at least on part of the stem 4 which is intended to be embedded in the handle head 2, an elongated covering sheath 5 of elastically yielding material is applied, preferably an elastomer or a high density foam material. The material with which the covering sheath is manufactured must withstand the moulding temperature and pressure of the plastic material of the handle head 2.

For the purposes of the inventive solution provided here, it is important that the sheath 5 is able, from the internal part, to well adhere to the roughness of the twist of metal wires, so as to fill at least partially the recesses within the helical shape and fill any possible gap which would let pass a fluid under pressure, and from the external part, to sufficiently deform to remain in seal coupling with the surface of the seat T' of the mould. In this way, the sheath 5 is configured as a kind of bearing interposed between the twisted metal wire stem and the mould seat, filling every gap also in case of a great relative dimensional tolerance between stem 4 and mould seat

T'.

The covering sheath according to the invention is a constant section element having, generally, a tubular shape and a great elongation, e.g., having a length of at least 2.5 mm. This tubular shape of the covering sheath is an important geometric aspect to offer all the desired benefits. As shown in the drawings, the covering sheath 5 covers at least a majority of the terminal part of the retaining stem 4 that is free of bristles.

According to a first embodiment, the covering sheath 5 is made of a part 5 of small tube of elastomeric material, which is produced separately and then inserted with an interference on the stem 4 tang.

The external diameter of the small tube is nominally equal to or slightly greater than the internal one of the mould seat T', so that it can seal couple on this latter when the mould is closed for the injection of plastic material; the external diameter is, e.g., between 1.2 mm and 2.5 mm. The internal diameter of the small tube is substantially equal to or slightly lesser than the external diameter of the stem 4, so as to exploit the elasticity of the elastomeric material for an easy insertion, but, at the same time, ensure a close adhesion on the stem 4; the internal diameter is, e.g., between 0.3 mm and 0.8 mm.

The length of the small tube is 2.5-5 mm.

The part 5 of the small tube is mounted on the stem 4 so that an external end 5' thereof projects from the handle head 2 end from a few tenths of a millimetre to a few millimetres, so as to preferably end adjacent to the first bristles 3.

Internally to the handle head 2 body, the part 5 of the small tube preferably end at a folding area of the stem, e.g., a knee portion or a portion folded at 90° (as shown in FIG. 2). This allows to retain more effectively the sheath 5 on the stem 4, but also to lock more firmly the stem 4 itself in the handle head 2 material.

Figure 2A:
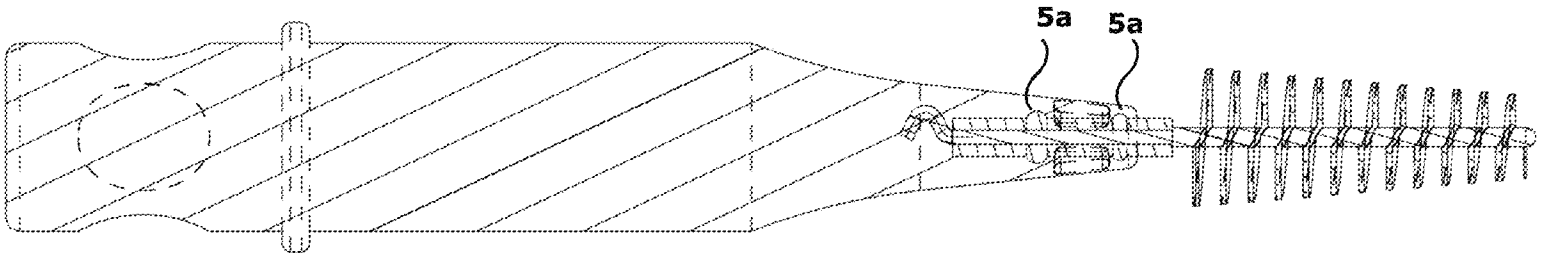
FIG. 2A is a view similar to that of FIG. 2 of an alternative embodiment.
Figure 7A:
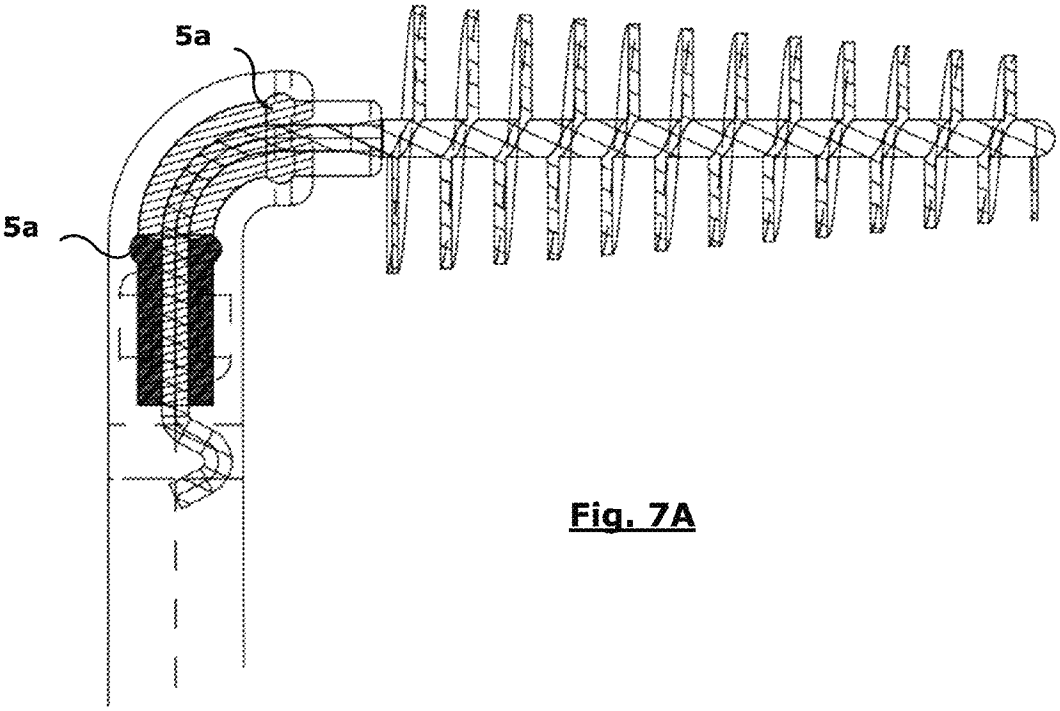
FIG. 7A is a longitudinal sectional view of another embodiment of the invention.
Figure 4:
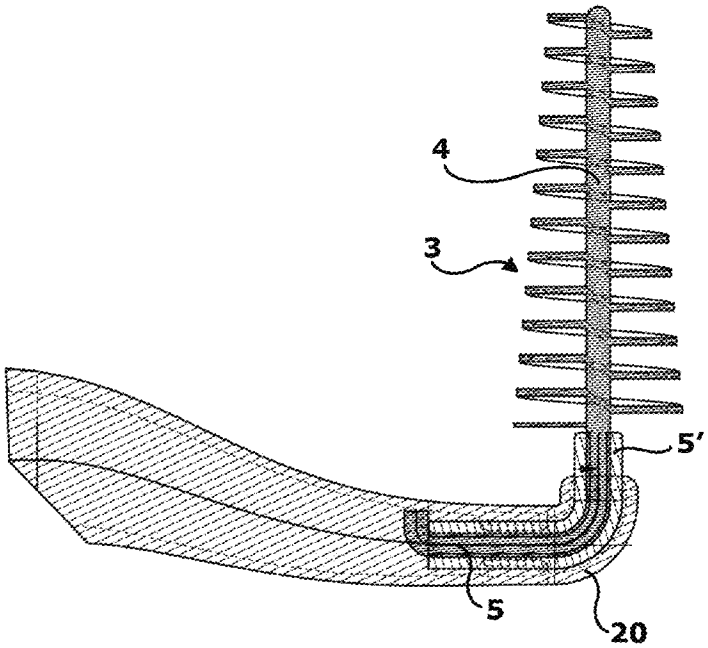
FIG. 4 represents a longitudinal section thereof.
Figure 4A:
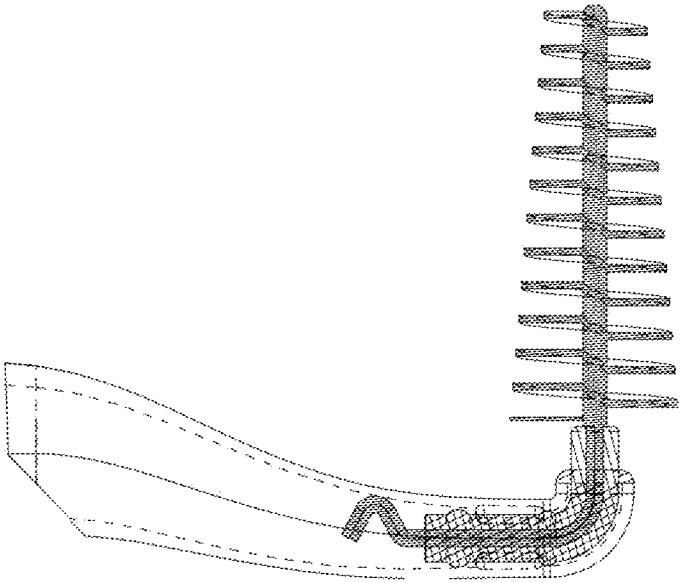
FIG. 4A is a view similar to that of FIG. 4 of another embodiment of the invention.
Figure 5A:
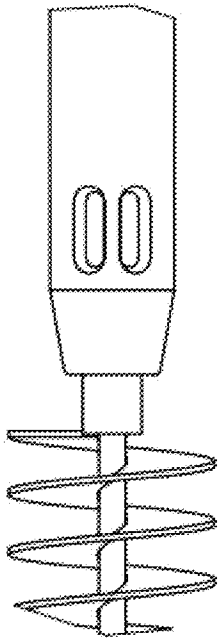
FIG. 5A is a partial enlarged view of the detail within the circle B of FIG. 5.
Figure 5:
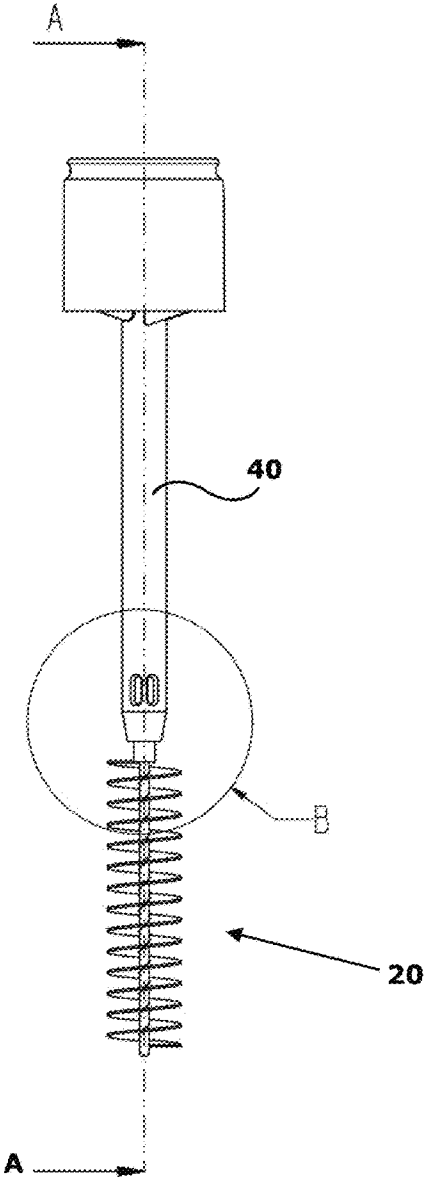
FIG. 5 is an elevational side view of another embodiment of the invention, embedded in a mascara brush.
Figure 6A:
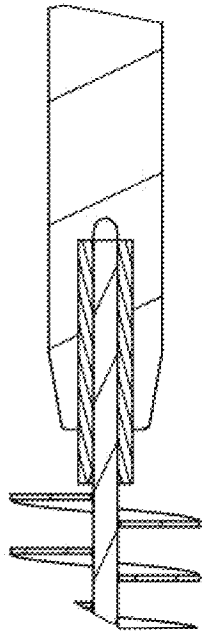
FIG. 6A is a partial enlarged view of the detail within the circle A of FIG. 6.
Figure 6:
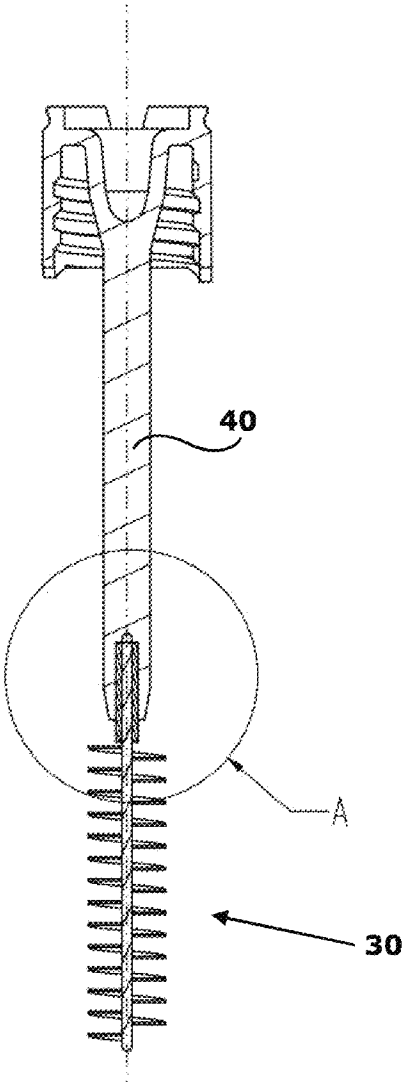
FIG. 6 is a longitudinal sectional view according to the line A-A of FIG. 5.
Figure 8:
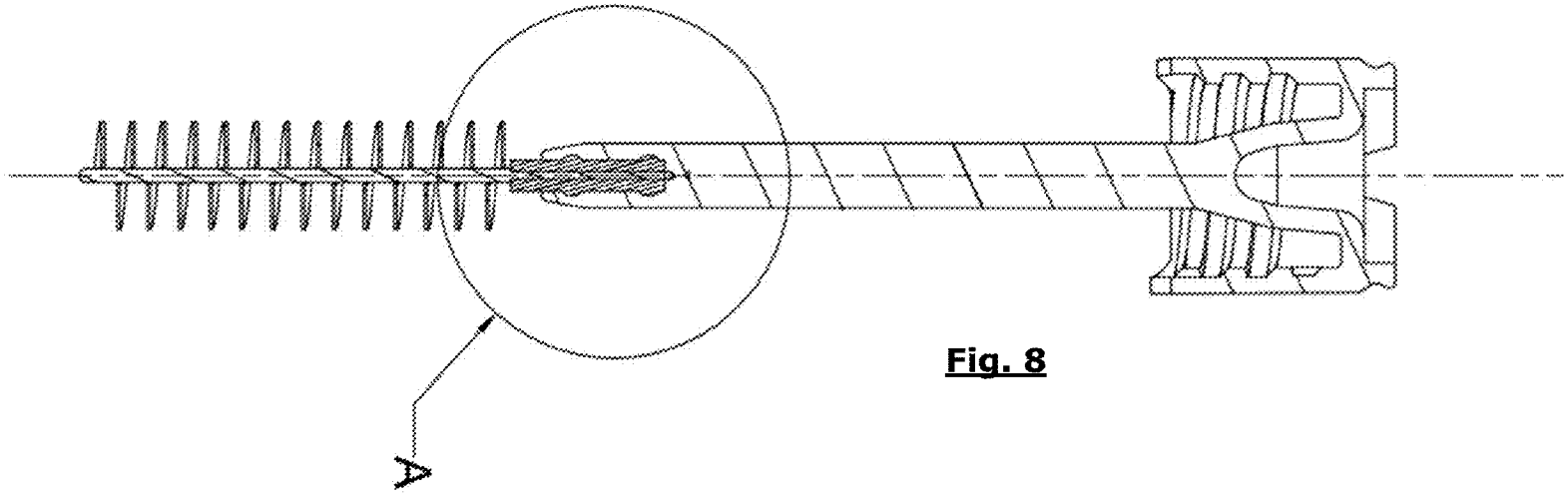
FIG. 8 is a view similar to that of FIG. 6 of another embodiment.
Figure 8A:
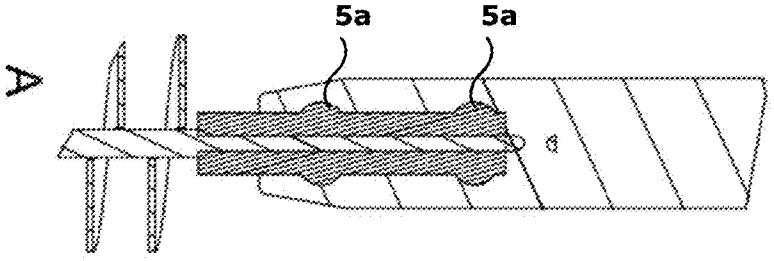
FIG. 8A is a partial enlarged view of the detail within the circle A of FIG. 8.

Another terminal folding mode of the stem, in the form of knee, is illustrated in FIGS. 2A and 4A.

The small tube 5, as mentioned, is made of a thermoplastic, preferably elastomeric material, which has an elasticity and yieldably degree appropriate to its function; first of all, an elasticity such that, when the mould T is closed, with its cylindrical seat T' clamped on the small tube 5, the elastomeric material of which it is made, fills at least in part, the said gaps between the cylindrical surface of the seat T' and the surface of the twisted wire stem 4; but, furthermore, the elasticity of the small tube 5 is fundamental to adequately support the metal stem 4 of the tang and avoid that it is permanently folded during use.

To obtain a better behaviour in the assembly step, it is preferably to choose a small tube 5 of greater internal diameter than that of the stem 4, with a small play. In this case, the sheath 5 is a thermo-shrinkable plastic material so that, before placing the brush in the mould, the thermoplastic small tube is preliminary heated, to obtain a thermo-shrinking which makes the material perfectly adhere to the irregular surface of the twisted wires of the stem 4.

Suitable thermoplastic materials are, in general, all the elastomers such as, e.g., those belonging to the groups designated by the symbols: SB, SBS, SEBS, SI, TPE-A, TPE-E, TPE-0, TPE-U, EVA, TPC-ET and not only, having variable hardness grade in relation to the tang diameter.

According to another embodiment, the sheath 5 is obtained in situ by dipping in the plastic material in the liquid or fluid state, which perfectly wets the tang portion of the stem 4. Following the hardening of the coating material, by cooling or cross-linking, the coating sheath 5 is perfectly formed and stabilized in the desired thickness and elastic module.

A further embodiment, provides that the sheath 5 is obtained by winding a tape of plastic material according to a plurality of turns around the tang portion of the stem 4. The turns of the tape wound on the stem can be consolidated to each other and stabilized, e.g., through welding with heat addition.

Figure 3A:
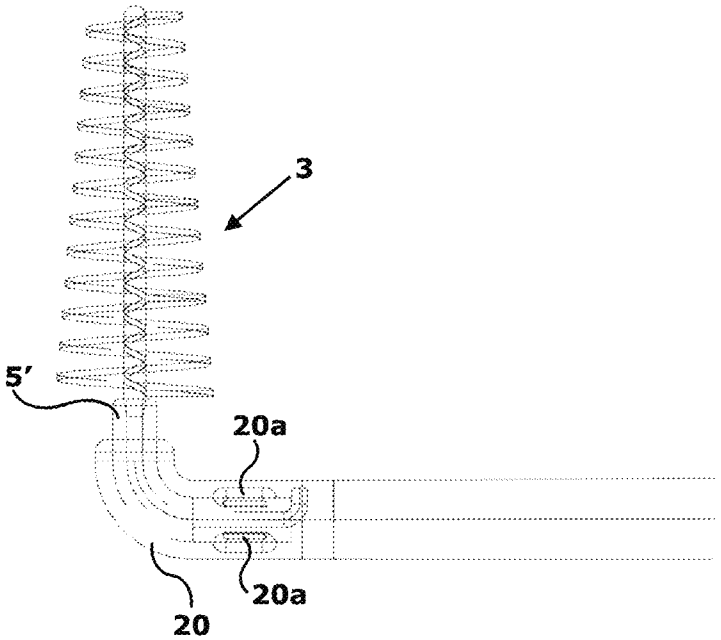
FIG. 3A represents a partial enlarged elevational view.
Figure 3:
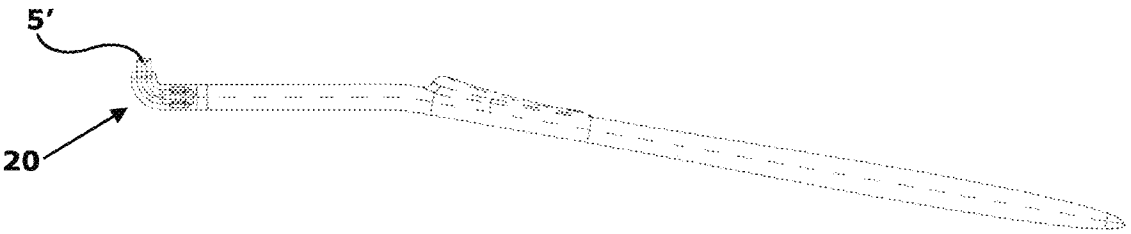

In FIGS. 3, 3A and 4 a different embodiment is shown, in which the terminal tang of the stem 4, after being covered with the sheath 5, is generally folded at right angles of about 90°: in this way the main axis of the bristled brush is arranged perpendicular with respect to the main axis of the handle terminal head 20.

Figure 1:
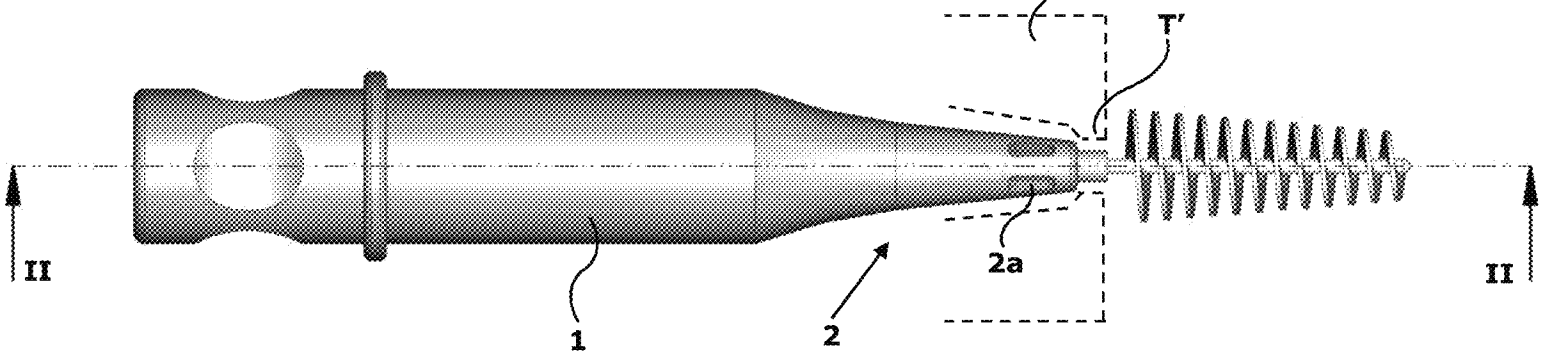
FIG. 1 is an elevational side view of the brush-like device according to a first embodiment of the present invention embedded in an interdental brush.

As well shown in FIGS. 1 and 3A, the handle head 2 and 20 has, at the central area of the sheath 5, a plurality of radial recesses 2*a* and 20*a*, e.g. four in number, which form the impressions of corresponding mould retaining pins (not shown).

In other words, for the support of the brush into the mould, on the one hand, it is exploited the outlet seat of the mould which tightly engages with the sheath 5 and, on the other hand, pins are arranged inside the mould which abut against points located circumferentially around the sheath 5, according to several opposite radial directions, so as to support the tang well centered in the desired position in the mould cavity.

FIGS. 5, 5A, 6 and 6A illustrate a different application of the invention to a mascara brush. In this case, the stem of a mascara brush 30 is embedded in a shank 40 of a plastic material handle intended to close the mascara container. The structure principles and construction methods are completely identical to those described above and, therefore, they will not be repeated.

FIGS. 2A, 7A and 8-8*a* illustrate a further embodiment, in which the support sheath 5 has also external projections, e.g., annular ribs 5*a*: they ensure a better retention of the sheath in the moulded material of the handle. This particular solution allows to firmly lock the stem in the handle and easily overcome the severe endurance tests, imposed to avoid that the bristled part may detach from the handle.

As can be understood from the above description, the use of the sheath 5 on the tang of the brush allows to perfectly achieve all the objects exposed in the premises.

In fact, the soft sheath 5 allows to adequately clamp the mould on the stem of the brush, even in case of wide tolerances of the stem 4 size, which are absorbed by the compressibility of the sheath, without affecting the integrity and the elastic properties of the metal stem. The presence of the covering sheath 5 ensures a perfect seal both with the surface of the mould and with the irregular surface of the metal stem so that, when the plastic material is injected in the mould, material which will constitutes the handle 1, 2, this fluid material, even under high pressure, does not has the possibility to leak from the seat T' and avoids the formation of burrs.

However, at the same time, the elongated sheath 5 is simple to manipulate and apply on the stem 4 and does not have problems in term of centered with respect to the mould.

Furthermore, since the sheath 5 projects outside and is extended beyond the mould, it can extend up to the bristles on the brush, thereby ensuring a good aesthetic effect—because it hides the stem—but also a good technical effect in terms of mucous or skin protection from the contact with the metal part and in terms of elastic support of the stem itself.

Finally, the friction coefficient of the sheath material, possibly assisted by the presence of asperities on the external surface of the sheath, as the annular ribs 5*a*, cooperate to a perfect holding of the stem in the handle.

It is understood, however, that the invention is not to be considered as limited by the particular arrangements illustrated above, which represent only exemplary embodiments of the same, but different variants are possible, within the reach of a person skilled in the art, without departing from the scope of the invention, as defined by the following claims.

The invention claimed is:

1. A method of manufacturing a brush having a bristled part (3) with bristles (3') located on one end part of a retaining stem (4), the retaining stem (4) having a terminal part free of the bristles (3') located on another end part of the retaining stem, the method comprising:

adhering a covering sheath (5) of elastically yieldable material on the terminal part of the retaining stem (4) with at least a majority of a total length of the terminal end that is free of the bristles (3') being covered by the sheath (5), said covering sheath being of elongate tubular shape having a length of at least 2.5 mm; and after said adhering step, obtaining a handle head portion (2) by moulding a plastic material on the terminal part of the retaining stem (4) over and adhering to the covering sheath, said terminal part of the retaining stem (4) being retained in a moulding position by a through seat (T') of a mould (T) which closes on said retaining stem.

2. The method of claim 1, wherein said elastically yielding material is an elastomer or a high density foam material.

3. The method of claim 1, wherein, said retaining stem (4) is comprised of twisted metal wires, said covering sheath (5) is made of a part (5) of a small tube, axially inserted on said retaining stem (4), having an internal diameter less than the nominal diameter of said retaining stem (4) and an external diameter equal to or greater than the internal diameter of said seat (T') of the mould (T), said covering sheath being adhered to the terminal part of the retaining stem with an inside surface of said covering sheath, along the internal diameter of said covering sheath, filling gaps along the twisted metal wires of said retaining stem to have the covering sheath in seal coupling with the through seat (T') of the mould (T) which closes on said retaining stem.

4. The method of claim 1, wherein said covering sheath (5) is made of a part (5) of a small tube, of thermo-shrinkable material axially inserted on said retaining stem (4) and, during said adhering step, heated so as to thermo-shrink said small tube to clamp and adhere said small tube to the retaining stem (4).

5. The method of claim 1, wherein said covering sheath (5) is applied on said stem (4) so as to project at least 0.5 mm from the outlet of said seat (T') of the mould (T).

6. The method of claim 5, wherein said covering sheath (5) extends up to be adjacent to a bristled area of the brush.

7. The method of claim 1, wherein said covering sheath (5) is applied so as to extend on said stem (4) internally to said handle head (2) up to a knee or terminal folding of the stem (4).

8. A device comprising:

a bristled part (3) with bristles (3') located on one end part of a retaining stem (4), the retaining stem (4) having a terminal part free of the bristles (3') located on another end part of the retaining stem;

a handle (1) ending in a moulded handle head (2) of plastic material on the terminal part of the retaining stem (4) of the bristled part (3), the bristled part (3) being fixed to the moulded handle head (2); and a covering sheath (5) of elastomeric material located intermediate an external surface of the terminal part of the retaining stem (4) of the bristled part (3) and an interior surface of the moulded handle head (2), said covering sheath having an elongated tubular shape having a length of at least 2.5 mm, said covering sheath (5) being adhered in contact to the external surface of the terminal part of the retaining stem (4) of the bristled part (3) and the interior surface of the moulded handle head (2), wherein at least a majority of a total length of the terminal end that is free of the bristles (3') is covered by the sheath (5), the device being obtained by the manufacturing method of claim 1.

9. The device of claim 8, wherein said retaining stem (4) is comprised of a pair of twisted metal wires and said covering sheath (5) is adhered in contact to an external surface of the pair of twisted metal wires in the terminal part of the retaining stem (4) of the bristled part (3).

10. The device of claim 8, wherein said covering sheath (5) extends from a terminal end of the moulded handle head (2) over a part of the retaining stem (4) between said terminal end of the moulded handle head (2) and the bristles (3') of said bristled part (3) of the device.

11. The device of claim 8, wherein an external surface of said covering sheath (5) has projections (5*a*), said projections (5*a*) retaining the covering sheath (5) in the moulded handle head (2) and locking the retaining stem (4) within the moulded handle head (2).

12. The device of claim 8, wherein said retaining stem (4) is comprised of a pair of twisted metal wires and said covering sheath (5) is adhered in contact to an external surface of the pair of twisted metal wires in the terminal part of the retaining stem (4) of the bristled part (3), an external end (5') of the covering sheath (5) projecting at least 0.5 mm from the terminal part of the retaining stem (4) towards the bristles (3') of said bristled part (3) of the device.

13. The device of claim 9, wherein an external surface of said covering sheath (5) has annular ribs (5*a*), said annular ribs (5*a*) retaining the covering sheath (5) in the moulded handle head (2) and locking the retaining stem (4) within the moulded handle head (2).

14. The device of claim 12, wherein an external surface of said covering sheath (5) has annular ribs (5*a*), said annular ribs (5*a*) retaining the covering sheath (5) in the moulded handle head (2) and locking the retaining stem (4) within the moulded handle head (2).

15. The device of claim 8, wherein, the device is an interdental brush, the retaining stem (4) is comprised of a pair of twisted metal wires and the covering sheath (5) is adhered in contact to an external surface of the pair of twisted metal wires in the terminal part of the retaining stem (4) of the bristled part (3), an external end (5') of the covering sheath (5) projects from the handle head towards the bristles (3') of said bristled part (3), and the retaining stem (4) and the handle head (2) include a 90° fold such that a main axis of the retaining stem (4) that includes the bristles (3') is arranged perpendicular with respect to a main axis of the handle (1).

16. The device of claim 15, wherein an external surface of said covering sheath (5) has annular ribs (5*a*), said annular ribs (5*a*) retaining the covering sheath (5) in the moulded handle head (2) and locking the retaining stem (4) within the moulded handle head (2).

17. The device of claim 9, wherein said covering sheath (5) is comprised of a thermo-shrinkable plastic material, and said covering sheath (5) is thermo-shrunk adhered on the retaining stem (4).

* * * * *